United States Patent [19]

Swanson

[11] 4,139,773

[45] Feb. 13, 1979

[54] METHOD AND APPARATUS FOR PRODUCING BRIGHT HIGH RESOLUTION ION BEAMS

[75] Inventor: Lynwood W. Swanson, McMinnville, Oreg.

[73] Assignee: Oregon Graduate Center, Beaverton, Oreg.

[21] Appl. No.: 848,386

[22] Filed: Nov. 4, 1977

[51] Int. Cl.[2] ..... H01J 27/00

[52] U.S. Cl. ..... 250/423 R; 313/351

[58] Field of Search ..... 250/423 F; 313/336, 313/351

[56] References Cited

U.S. PATENT DOCUMENTS

| | | | |
|---|---|---|---|
| 3,405,263 | 10/1968 | Wanless et al. | 250/423 F |
| 3,809,899 | 5/1974 | Baker et al. | 250/423 F |

*Primary Examiner*—Harold A. Dixon

*Attorney, Agent, or Firm*—Cahill, Sutton & Thomas

[57] ABSTRACT

A field ionization source includes a <110> oriented iridium emitter, the tip of which is initially built up in the <110> direction. A negative voltage is applied to the emitter after the emitter has been heated to approximately 2000° C. thereafter, the emitter is cooled to approximately 1200° C. Crystalline buildup of the pointed iridium tip occurs in the <110> direction. After buildup has occurred, the emitter is cooled sufficiently to "freeze" the tip in the built up configuration. The negative voltage is then removed. A gas containing molecules to be ionized is differentially pumped at relatively high pressure through a tube into a region immediately around the emitter tip enclosed by a cathode cap having an aperture through which the ion beam is accelerated. The iridium emitter is mounted in thermal contact with a liquid nitrogen reservoir, which maintains the emitter at near-cryogenic temperatures. The gaseous source of molecules is also maintained in thermal contact with the liquid nitrogen reservoir which cools the gas to near-cryogenic temperatures. A positive voltage of sufficient magnitude to cause ionization of molecules from the gas is applied to the emitter with respect to the cathode cap. The ions are accelerated through the aperture of the cathode cap by the electric field between the emitter and the cathode cap, thereby forming the ion beam.

22 Claims, 3 Drawing Figures

METHOD AND APPARATUS FOR PRODUCING BRIGHT HIGH RESOLUTION ION BEAMS

BACKGROUND OF THE INVENTION

1. Field of the Invention

The invention relates to field ionization sources and field ion guns for producing intense, high resolution ion beams.

2. Brief Description of the Prior Art

The desirability of an ion gun capable of issuing stable, high current, high resolution focused ion beams has increased with the increased interest in and use of ion beams in applications such as scanning transmission ion microprobes, ion-probe microanalysis, fine ion beam sputtering and ion implantation of doped regions into semiconductor integrated circuits. Present limitations of photolithography in integrated circuit fabrication and present limitations in integrated circuit mask making procedures have also resulted in an increased interest in such ion beams. See "Focused Ion Beams in Microfabrication" by R. L. Seliger and W. P. Fleming, *Journal of Applied Physics, Vol.* 45, No. 3, March 1974, page 1416–1422; also see "Proton Scanning Microscopy: Feasibility and Promise", by Riccardo Levi-Setti, *Proceedings of the Seventh Annual Scanning Electron Microscope Symposium,* IIT Research Institute, Chicago, Ill., April 1974.

Field ionization sources have been utilized to produce substantially brighter, higher resolution ion beams than ion beams which are produced by conventional duo-plasmatron ion sources. The field ionization source is unique in that the apparent or virtual source size is very small, being of the order of 10 Angstroms. As a consequence, the brightness of the field ionization source can be very great. The principle of operation of the field ionization source is that when a molecule is placed in a very high electric field (of the order of $10^8$ volts/cm) there is an appreciable probability that the molecule will be ionized. In a field ionization source an electric field of sufficient strength to ionize the molecules may be created at the tip of a field emitter with a tip radius of approximately 1000 Angstroms by applying a high voltage, e.g., 10,000 volts, to the field emitter, (hereinafter referred to simply as the emitter.)

A stable "built up" tip having a very small effective radius for thermal field emission cathodes is described in my U.S. Pat. No. 3,817,592. Several basic sources of molecules to be ionized have been utilized, including gases, liquid films condensed from such gases onto the emitter, and the emitter material itself. If the best performances of conventional (duo-plasmatron) ion sources are extrapolated to approximately the 500 Angstrom beam diameter range, the ion beam current is approximately $10^{-12}$ amperes. Ion beams characterized by this level of current lack sufficient brightness to perform many useful operations, such as high resolution sputtering or implanting, at a sufficiently high rate to be of commercial importance. Likewise, field ionization sources or field ion microprobes do not produce narrow, high resolution beams of sufficient intensity to perform many useful operations at a sufficiently high rate to be of commercial importance.

Accordingly, a broad object of the invention is to provide a field ion gun having increased brightness for producing high resolution ion beams.

Another object of the invention is to provide an improved field ionization source by utilizing a built up emitter to increase brightness along the emitter axis.

Chemical activity at the emitter surface may be greatly accelerated by high electric fields; accordingly, certain combinations of emitter material and ionizable material have been found to be undesirable. For example, water molecules attack tungsten very rapidly and will destroy or substantially deteriorate the characteristics of an emitter within a few minutes if a high magnitude electric field is applied and the ambient pressure is of the order of $10^{-4}$ torr. To avoid this problem, it has heretofore been necessary to use expensive ultra-high vacuum systems designed to prevent water contamination.

Accordingly, another object of the invention is to provide a field ionization source having increased resistance to field-induced chemical etching of the emitter.

Ion beams produced by prior art devices have been characterized by an undesirably large energy spread, i.e., by a wide energy distribution of the ions in the ion beam. This reduces the resolution of the focused ion beam because of the inherent chromatic aberration of any lens system. The lens system focuses (i.e., deflects) different energy ions by a different extent, thereby resulting in poor resolution of the focused ion beam.

Accordingly, another object of the invention is to provide a field ionization source producing an ion beam characterized by a narrow energy spread and to achieve this object by controlling the temperature and pressure of a gaseous, atomic or molecular source to form a liquid film on the field emitter, thereby increasing the available supply of ionizable material.

SUMMARY OF THE INVENTION

Briefly described, and in accord with one embodiment of the invention, an ion gun is provided which emits an ion beam characterized by increased brightness, resolution, and stability. The structure includes a field ionization source in the form of a single crystal oriented iridium emitter having a very sharp tip built up in the <110> direction. The emitter and an ionization region immediately surrounding the emitter are enclosed by a cathode cap. The cathode cap has a small aperture which is aligned with a longitudinal axis of the emitter. A voltage supply is electrically connected between the cathode cap and the emitter to create a high electrical field at the emitter tip and to accelerate ions ionized at or near the emitter tip through the aperture in the cathode cap to produce the ion beam. Means are provided for controllably heating the emitter to high temperatures by running electrical current through the resistance of the emitter support filament. The field ionization source is attached to a vacuum column which encloses a vacuum chamber. The vacuum chamber housing encloses an electrostatic lens system for focusing and controlling the ion beam emitted by the field ionization source through the aperture in the cathode cap. The emitter and the ionization region are separated from the vacuum chamber by the cathode cap. A differential pumping system is utilized to maintain the gaseous source of ion at a high pressure, on the order of $10^{-2}$ torr, within the cathode cap by means of a regulated high pressure gas source. This gas is conducted by a tube through a wall of the liquid nitrogen reservoir into the region enclosed by the cathode cap. The differential pumping system also maintains the total gas pressure in the vacuum chamber at a relatively low pressure, on the order of $10^{-6}$ torr. The emitter is mounted in thermal contact with a liquid nitrogen cooling system. The tube passes through the liquid nitrogen cooling system. Thus, both the gas and the emitter are maintained at near-cryogenic temperatures. The term "near-cyrogenic temperatures" is used to mean tempratures below approximately 100° K. Iridium is preferably utilized as the emitter material in order to increase the resistance of the emitter tip to field-induced chemical etching by water molecules or other substances which may be present as impurities in the system. A high degree of brightness of the ion beam is achieved by "building up" the emitter tip. A stable emitter tip with a very small effective radius is thereby obtained. The method of building up the emitter tip includes a preliminary step of heating the emitter to approximately 1500° C. to clean the emitter of surface contaminants. Optionally, a small amount of oxygen may be introduced into the region enclosed by the cathode cap to further effect cleaning of contaminants from the emitter surface. The emitter temperature is then adjusted to a value between 1,000° C and 1,200° C. A negative voltage of sufficient magnitude to cause electron emission is then applied to the emitter with respect to the cathode cap, and electron emission proceeds. Build-up of the iridium emitter tip in the <110> direction then occurs. The temperature of the emitter is then lowered to less than 700° C. to "freeze" or solidify the emitter tip into the built up configuration. The negative voltage is then removed. To operate the apparatus as a field ion gun, the gas containing molecules to be ionized is then maintained at high pressure in the region enclosed by the cathode cap by a differential pumping system. A positive voltage of sufficient magnitude to cause optimum ionization of molecules at the built up tip of the emitter is then applied to the emitter. Control voltages are applied to the electrostatic lens system to focus the ion beam emitted through the aperture in the cathode cap. Liquid films may be formed on the emitter by condensation of certain gases near the emitter at certain valves of emitter temperature, gas temperature, gas pressure, and electric field near the emitter surface. Such liquid films greatly increase the supply of molecules available for ionization at the emitter tip. Ion beams ionized from molecules from such liquid films have a lower energy spread than beams of ions ionized from molecules in the gas phase. Such low energy spread ion beams can be focused with higher resolution because the effect of chromation aberration of the lens system is reduced.

DESCRIPTION OF THE INVENTION

Figure 1:
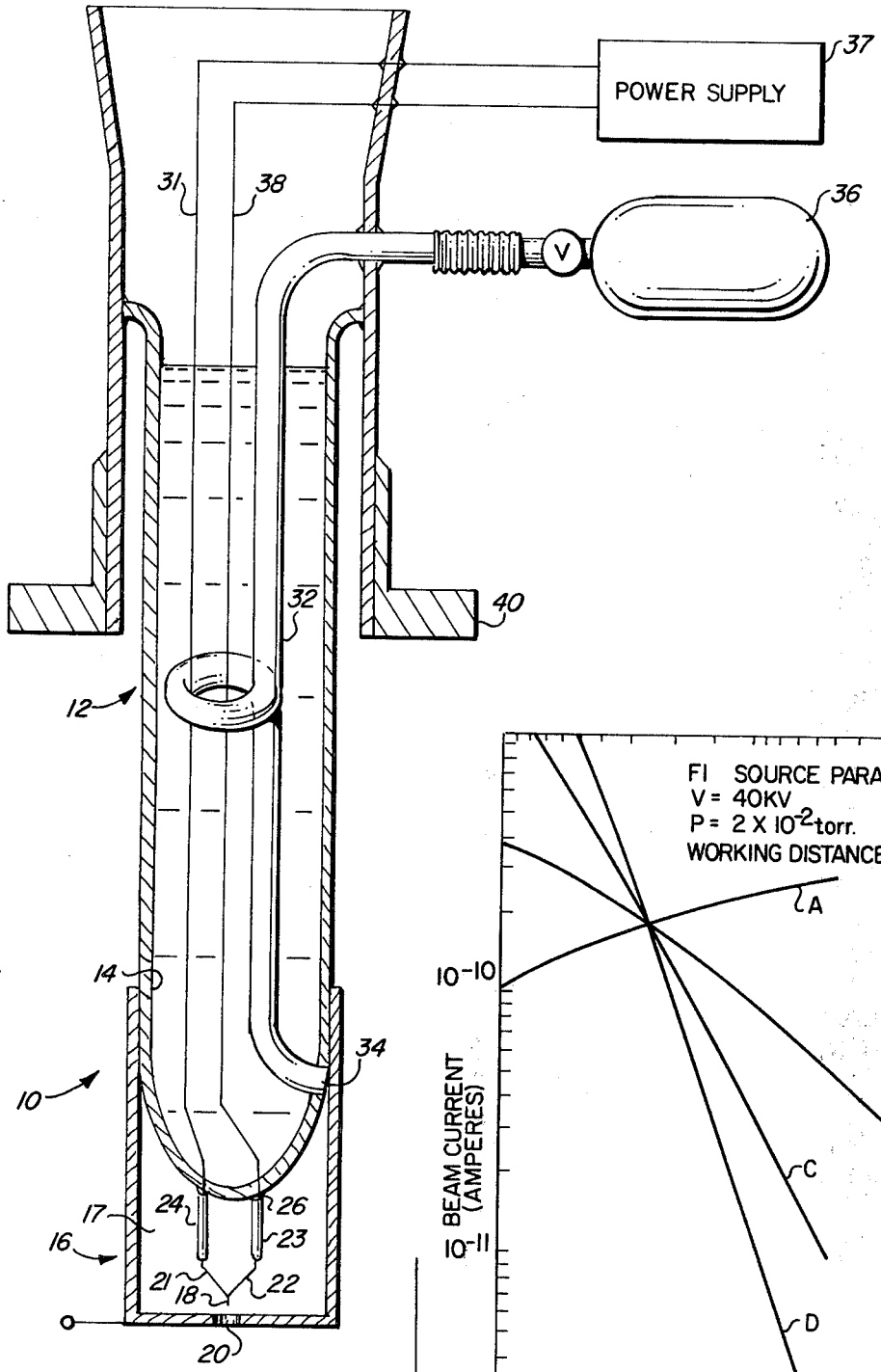
FIG. 1 is a cross-sectional diagram of a presently preferred field ionization source according to the invention.
Figure 2:
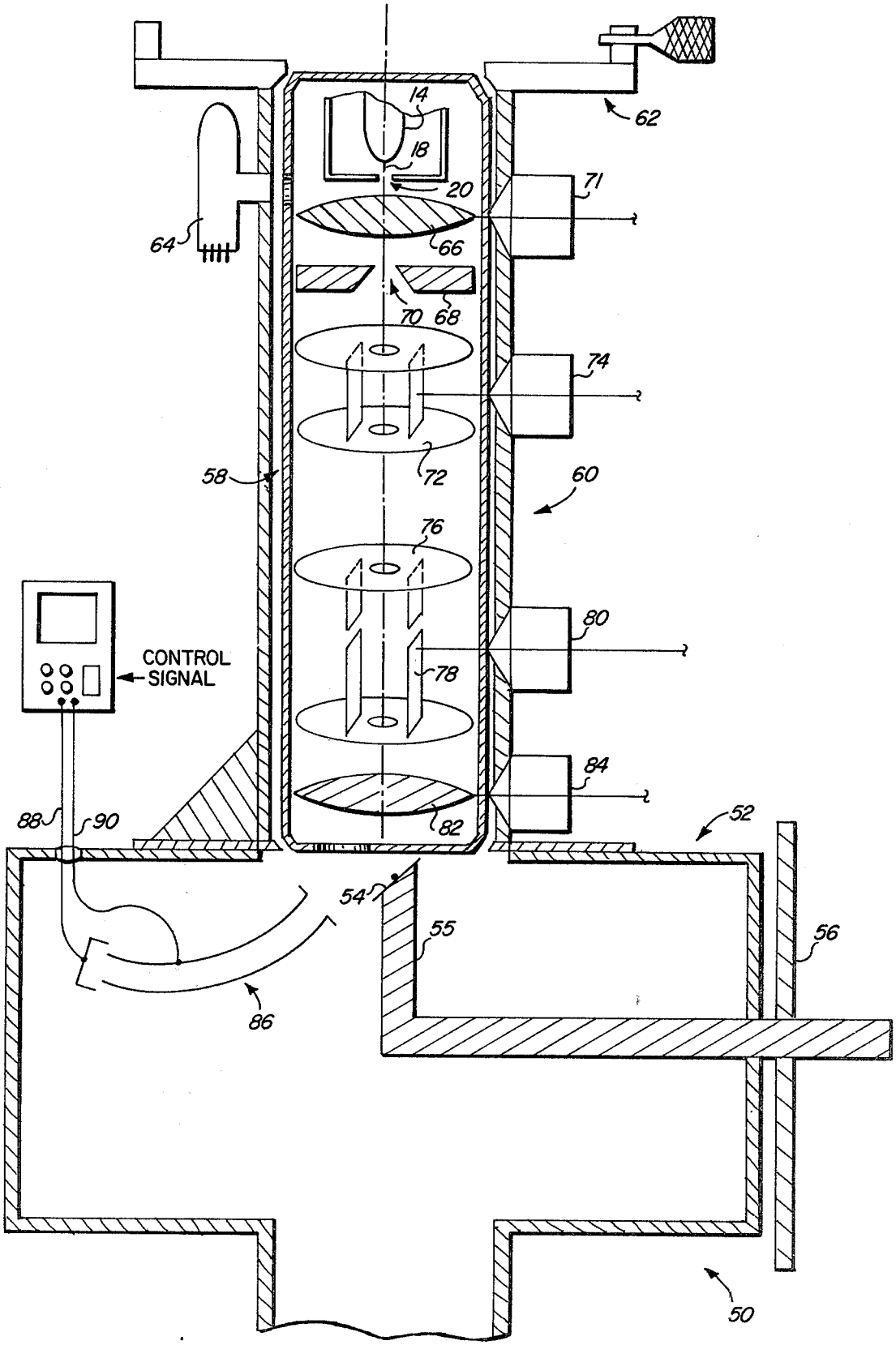
FIG. 2 is a cross-sectional diagram of an electrostatic optical system which may be combined with the field ionization source of FIG. 1 to provide a field ion gun.

The improved high brightness, high resolution field ion gun including both the field ionization source of FIG. 1 and the electrostatic optical system of FIG. 2 is capable of providing sub-micron beam spot sizes with current densities of 0.1 to 10 amperes per square centimeter, depending on ion species. The improved field ion gun may be utilized in a number of applications, including high resolution sputtering, ion implantation, and ion micro-probe applications in areas such as production of integrated circuits and other solid-state devices and production of masks used for the manufacture of integrated circuits.

Referring to FIG. 1, field ionization source 10 includes a liquid nitrogen reservoir 12, which includes a precision tube section 14 thereof. A precise sealed fitting "cathode cap" 16 is attached to precision tube section 14. Precision tube section 14 may be made of glass. Cathode cap 16 has a small aperture 20, which may be approximately 0.5 millimeters in diameter. (The exact diameter is not critical.) Aperture 20 is aligned with the longitudinal axis of emitter 18, and is located approximately 0.25 millimeters from the emitter tip. Cathode cap 16 is electrically conductive. Terminal 30 permits an appropriate voltage difference to be established between cathode cap 16 and emitter 18, thereby causing ions ionized at emitter 18 to be accelerated through aperture 20 to form an ion beam. Emitter 18 may be a "built up" field emitter of a type similar to one described in my U.S. Pat. No. 3,817,592, issued June 18, 1974, and incorporated herein by reference. See especially FIG. 6 and the related discussion of the above patent.

Emitter 18 is preferably iridium and is supported by two tungsten wires 21 and 22, which in turn are supported by two tungsten posts 23 and 24 Tungsten posts 23 and 24 thermally couple tungsten wires 21 and 22 and emitter 18 to liquid nitrogen reservoir 12, thereby cooling emitter 18 to near cryogenic temperatures. Tungsten wires 21 and 22 and tungsten posts 23 and 24 also electrically couple emitter 18 to conductors 38 and 39. Conductors 38 and 39 may be also composed of tungsten.

Conductors 31 and 39 are electrically coupled to voltage source 37. Voltage source 37 applies an appropriate high positive voltage to emitter 18 during the field ionization process, and also applies an appropriate high negative voltage to emitter 18 during an emitter tip build-up procedure. During a preliminary cleaning procedure and during the emitter build-up procedure voltage source 37 also applied a sufficient voltage difference between conductors 38 and 39 to cause emitter 18 to be heated to temperatures in the range from 1,000° to 2,000° C., as described hereinafter and also described in the above-referenced Swanson patent.

A gas containing molecules to be ionized, e.g. argon, hydrogen, helium, $CH_4$, or any one of a large number of other suitable gases, is forced through a gas tube 32 at a relatively high pressure on the order of $10^{-2}$ torr into the volume 17. Volume 17 is enclosed by cathode cap 16 and a portion of the wall of liquid nitrogen reservoir 12 Gas tube 32 passes through the liquid nitrogen coolant in reservoir 12 and exits into enclosed volume 17 through opening 34. Gas tube 32 is connected to regulated high pressure gas source 36, which may be a tank of the gas of the required purity. Gas source 36 includes a regulated pressure valve. As the gas is pumped through tube 32, it is cooled to near liquid nitrogen temperatures by the time it enters enclosed volume 17, and is then further cooled by the portion of the reservoir wall bounding volume 17.

Reservoir 12 is mounted in a sealed flange 40 which is attached to the vacuum column 60 of FIG. 2. The total gas pressure in the vacuum chamber within vacuum column 60 is maintained at a relatively low pressure on the order of $10^{-6}$ torr by differential pumping of all gas molecules, including those which escape from the high pressure gas in volume 17 through aperture 20 into the vacuum chamber, by means of pump 64. Pump 64 may be a diffusion pump, a turbo-molecular pump, or a cryo-pump, all of which are readily commercially available.

For gas phase ionization, the ion beam current may be enhanced greatly by cooling both the gas and the emitter. For example, the ion beam current for $H_2$ at 77° K. is approximately fifty times greater than it is at 300° K. For a properly adjusted ion source nearly all of the ionization will take place in an extremely narrow zone immediately in front of the emitter tip. This narrow zone is referred to as the "ionization region".

The ion source is properly adjusted when the voltage applied to the emitter is of sufficient magnitude that the ion beam energy spread does not exceed the maximum acceptable value for the desired application, while the ion beam current is nevertheless sufficiently large to meet the requirements of the desired application of the field ionization source. The opposing requirements of high ion beam current and low ion beam energy spread must be balanced. On one hand, the ionization rate increases very rapidly as a function of the magnitude of the emitter voltage, thereby causing increased ion beam current. On the other hand, the region of high probability of ionization extends further away from the emitter tip as the magnitude of the voltage applied to the emitter increases, thereby increasing the energy spread of the ion beam. Molecules ionized further from the emitter tip, the point of maximum energy, have a lower energy at the time they are acclerated through the aperture in the cathode cap than molecules ionized at the emitter tip.

Gas molecules in the high field region near the emitter tip are electrically polarized. This causes them to be acclerated by the electric field toward the emitter tip. The kinetic energy of the incoming gas molecules is more effectively accommodated by the emitter if the emitter is at a low temperature. Further, the gas molecules will initially have less kinetic energy if the gas is at a low temperature. Thus, the conditions for molecules to be trapped by the electric field and to remain in the region near the tip of the emitter (where electric field intensity and ionization probability are highest) are far more favorable at low gas temperatures than at high gas temperatures.

The ion beam current is proportional to both the probability of ionization of molecules in the ionization region and the number of molecules in the ionization region, where the electric field intensity is sufficiently high to create a substantial probability of ionization of the molecules. At lower temperatures the density of the gas is higher, therefore the number of molecules available in the ionization region is higher. As previously mentioned, individual molecules in the gas phase are polarized in the presence of the high intensity field, which causes the polarized molecules to be attracted to the region of highest field intensity, i.e., to the emitter tip, thereby also increasing the number of molecules in the ionization region. It is thus seen that the number of molecules available in the ionization region generally increases with decreasing gas temperature, the exact functional relationship of the density of molecules to temperature is quite complicated.

The previously described polarized gas molecules accelerated to the emitter tip have kinetic energy which must be dissipated. If the emitter is at a low temperature, the incoming ions impart more of their kinetic energy to the emitter, and are less likely to bounce off the emitter and out of the ionization region. Further, the bound atoms of the emitter tip have less vibrational energy at low temperatures and are less likely to impart their vibrational energy to the polarized molecules which have come to rest at the emitter tip, causing them to be knocked outside of the ionization region. Further, molecules in a cold gas initially have less kinetic energy, making it less likely that they will bounce outside the ionization region when they collide with the emitter. Thus, the supply of molecules available for ionization in the high probability region is greatly increased at low gas temperatures and low emitter temperatures.

The field ionization current is also proportional to gas pressure. The gas pressure in the ionization region within cathode cap 16 is maintained at approximately $10^{-2}$ torr by the regulated pressure valve of gas source 36. Further, molecules may be condensed from the gas onto the cold emitter under certain conditions of gas temperature, gas pressure, emitter temperature and electric field strengh near the emitter tip. This greatly increases the supply of molecules available for ionization at the emitter tip. This effect has been seen with hydrogen at 4° K. by Jason, et al, *Journal of Chemical Physics,* Volume 52, Page 2227 (1970), incorporated herein by reference. Liquid film formation with argon gas at 77° K. was seen in the course of this invention. The emitter temperature was also approximately 77° K. and the argon gas pressure was approximately $10^{-2}$ torr.

A lower beam energy spread is believed to result from the use of a liquid film condensed on the emitter because the vast majority of the ions in the beam are believed to be ionized at the emitter tip. Therefore all of the ions should have substantially the same energy. This result is potentially very important, because the effect of chromatic aberration in the lens system, which is the limiting factor in producing narrow high current focused ion beams, is greatly reduced.

Certain combinations of emitter material and ionizable molecules or impurity molecules in the system are known to be incompatible. For example, water molecules attack tungsten very rapidly when a high electric field is present. Consequently, water molecules present as impurities in th system of FIG. 1 may substantially alter the ion emission characteristics of a tungsten field emitter in a few minutes under typical operating conditions. Water molecules are very strongly attracted to the emitter tip by the electric field because of the permanent dipole moment of a water molecule. Consequently, the pressure of water molecules at the emitter tip may exceed the background water pressure in the system by a factor of $10^{10}$ to $10^{12}$. Therefore, expensive, baked, ultra-high vacuum systems may be required to keep the background water pressure very low.

However, it has been found advantageous in the course of the present invention to use iridium emitters. Iridium is much more resistant to field-induced chemical etching in the presence of water molecules. It is also more resistant to field-induced chemical etching due to oxygen and nitrogen molecules. (Such etching is much less severe for such molecules than for water molecules.) The cost of field ionzation sources which have virtually no water contamination is substantially higher than for systems which may have a minimal amount of water contamination, so the use of iridium emitters results in long lifetimes for the sharp emitter tip and highly reproduceable and stable ion beams without the requirement that expensive baked, ultra-high vacuum systems with negligible water contamination be utilized.

In order to achieve a high degree of brightness $\beta$ along the emitter axis on the order of $10^8$ amperes per steradian per square centimeter (which is a factor of $10^5$ greater than for conventional ion sources) it is necessary to have the smallest possible apparent source size, and the highest electric field strength at the apex of the emitter. According to one embodiment of the invention, a very small effective emitter radius and field enhancement at the emitter apex may be achieved by utilizing an iridium emitter with a tip built up in the <110> direction, in accordance with the method of my U.S. Pat. No. 3,817,592. However, other emitter materials may be used to provide built up tips. Tungsten built up in the <100> direction, tantalum built up in the <111> direction, and molybdenum built up in the <100> direction, may all be satisfactory in systems with negligible contamination by water molecules.

It should be noted that there are two unrelated considerations with respect to the importance of using built up iridium for scanning ion microprobe applications. First, iridium is an intrinsically superior emitter material because it is not as readily etched by the residual gases (usually water vapor) as are most emitter materials at high fields. This is the main reason that use of iridium as an emitter material is emphasized.

The second consideration concerns use of a built up emitter. This is done to cause the beam angular distribution to be directed down the emitter axis. The <110> direction of iridium produces the brightest beam intensity when the iridium is built up. For Tungsten it would be the <100> direction and for tantalum it would be the <111> direction, etc.

Build-up of the iridium emitter is accomplished in the electron field emission mode. This is done by first cleaning the tip by forcing a sufficient current through the iridium emitter to cause it to heat to approximately 1,500° C. An additional step which may be useful, especially if there is carbon contamination in the system, is to inject some oxygen into the system, either before the emitter is heated or while it remains at 1,000° C. to 1,200° C. Once the cleaning step has been completed, the emitter is operated in the field emission mode at a temperature between approximately 1,000° C. and 1,200° C. by applying a sufficiently negative voltage to the emitter to cause field emission of electrons. Build-up of the iridium emitter tip in the <110> direction then occurs. When build-up is complete, the temperature of the tip is lowered to a temperature less than 700° C. in order to freeze the emitter tip into the built up configuration. At this temperature or lower the negative voltage applied to the emitter may be removed. The gas containing molecules to be ionized is then pumped into the system as previously explained and an appropriate voltage is applied to the emitter. For example, for Hydrogen or Argon gas, a positive voltage between ten and twenty kilovolts may be applied to the emitter with respect to the cathode cap. The apparatus then operates as a field ionization source.

Referring to FIG. 2 the electrostatic optical system 50 includes an X-Y stage 62 which supports field ionization source 10. X-Y stage 62 is adjustable to permit alignment of cathode cap aperture 20 to the lens system described hereinafter. Cathode cap 16, emitter 18 and aperture 20 of the field ionization source of FIG. 1 are repeated in FIG. 2 for clarity. Electrostatic optical system 50 includes vacuum column 60 in which a low total pressure of at least $10^{-5}$ torr is maintained by pump 64. The gas pressure in volume 17 of FIG. 1 is maintained at approximately $10^{-2}$ torr, as previously explained. Lens tube 58 includes electrostatic objective lens 66 and electrostatic projector lens 82. (It should be noted that electrostatic lenses 66 and 82 are diagrammatically illustrated in FIG. 2 to indicate their beam focusing characteristics. An electrostatic lens actually is merely a metal disk with a centered round aperture therein. A high magnitude potential is applied to the metal disk, creating an electric field which deflects an ion beam or electron beam passing through the aperture.)

Objective aperture 68 is positioned below objective lens 66. Electrostatic stigmator 72 and double deflection beam scanning system 76 are arranged as shown in FIG. 2 between objective aperture 68 and projector lens 82. Electrical feed-through devices 71, 74, 80, and 84 are electrically coupled through vacuum column 60 and also through lens tube 58 to objective lens 66, stigmator system 72, deflection system 76, and projector lens 82, respectively. These components are all readily commercially available. The objective aperture 68 is a standard plantinum aperture commonly used in electron microscopes. The optical components are mounted in lens tube 58, which is 38 centimeters long, and which may be removed from vacuum column 60 without affecting the alignment of the components. Lens tube 58 is held rigidly in vacuum column 60.

The specimen, workpiece, or target 54 is located within specimen chamber 52, and is mounted on specimen holder 55, which is adjustable by means of specimen manipulator 56. Secondary electron emission from the specimen resulting from an ion beam focused on the specimen by electrostatic optical system 50 is detected by secondary electron detector 86. Secondary electron detector 86 may be a channeltron detector having outputs 88 and 9. The secondary electron detector outputs 88 and 90 produce signals which, in combination with the electrical signals applied to deflection system 76, are utilized to provide a CRT (cathoderay tube) display on the pattern formed or traced on specimen 54 by the ion beam.

In FIG. 2 the lenses are arranged as a doublet. The objective lens collimates the beam forming an image at $Z \approx \infty$ of size $d_1 \approx 2r_1$ where $$r_1 = M\left(\rho^2 + \left(1/4C_{s1}\,\alpha^3\right)^2 + \left(1/2C_{c1}\frac{\Delta V}{V}\,\alpha\right)2\right)^{\frac{1}{2}} \quad (1)$$

In the above equation, M is the magnification, $C_{s1}$ is the spherical aberration coefficient, and $C_{c1}$ is the chromatic aberration coefficient of the objective lens. $\Delta V$ is the energy spread of the beam, V is the acceleration voltage, $\alpha$ is the angular divergence of the beam as determined by the objective aperture, and $\rho$ is the apparent source size. The projector lens 82 focuses the collimated beam onto the specimen at a working distance of approximately $Rf_o$, where $f_o$ is the objective lens focal length, which may be approximately five millimeters, and R is the ratio of the projection lens and objective lens focal lengths. The amount of demagnification is M', which is equal to R/M. The overall magnification is $MM'=R$. The diameter of the beam on the specimen is $$d_2 = 2r_2, \tag{2}$$

where $$r_2^2 = M'^2 r_1^2 + (1/4\, C_{s2} (\frac{\alpha}{R})^3)^2 + (1/2\, C_{c2} \frac{\Delta V}{V} \frac{\alpha}{R})^2 \tag{3}$$

Using the values $f_o = 5.5$ millimeters, $C_{s1} = 88$ millimeters $C_{s2} = 4{,}000$ millimeters, $C_{c1} = 18$ millimeters, $C_{c2} = 150$ millimeters, $\rho = 10$ Angstroms, $\Delta V = 1$ ev, $V = 40$kv, $\alpha = 0.007$ radians, and $R = 6$ (30 millimeters working distance), the above equations yield the result that the diameter of the beam on the specimen is given by $d_2 \approx 1{,}000$ Angstroms.

The field ionization source of FIG. 1 is superior to conventional ion beam systems for high resolution focusing because the field ionization source is very much brighter. Measurements have shown that the field ionization source of FIG. 1 has a brightness of $\beta \approx 10^8$ amperes er cm$^2$ per steradian. This is a factor of $10^5$ greater than for conventional ion sources. Those skilled in the art will recognize that the brightness $\beta$ is a conserved quantity in optical systems because of Abbe's sine law, which is $$\sqrt{V}\, y \sin\theta = \sqrt{V'}\, y' \sin\theta', \tag{4}$$

for an aberrationless optical sytem where y is the source size, y' is the beam diameter on target. V is the beam energy at the source, and V' is the energy of the beam at the target. $\theta$ is the angle that the beam subtends at the source (i.e., the angle of divergence at the source), and $\theta'$ is the angle of convergence at the target. It will be evident to those skilled in the art that higher brightness sources are capable of delivering more ion beam current into small spots on the target. The total ion beam current of conventional sources typically exceeds that of a field ionization source by a factor of $10^6$, but when the beam spot-size y' is reduced below approximately 1,000 Angstroms the angle $\theta$ must become very small in order to obey Abbe's sine law, which reduces the current available or else requires impossibly high beam energy at the target. For example, assume that a conventional ion source has a typical source size $y=10^{-1}$cm, a value of $\theta=0.01$ radians, and a typical source voltage V=b 15,000 electron volts. If it is desired to a beam spot diameter of $y'=1000$ Angstroms ($5\times10^{-6}$cm) on the target and a value of $\theta'=0.002$ radians, then it is necessary that V', the energy of the beam at the target, be $V'=10^{13}$ electron volts. This is clearly an impossibly high beam energy. If, however, V' is desired to be 30,000 electron volts, then $\theta=10^{-4}$', so that even if $\theta'=90°$, an impossibly large value, equation (4) yields $\theta=10^{-5}$ radians. But this is a value far too small to permit reasonable ion beam current to be extracted from the above conventional ion surce. In fact, $\theta'$ would need to be of the order of 0.002, so that $\theta=3\times10^{-7}$. It may be shown that the ion beam current which would be extracted would then be approximately $10^{-12}$ amperes, too small a value to be of commercial importance in most applications.

In contrast, the field ionization source of the present invention, operating with a constant voltage beam and $\theta'=10^{-3}$, would require that $\theta=0.10$ radians; the ion beam current which would theoretically be extracted would be approximately $10^{-8}$ amperes. However, the latter discussion ignores the effect of lens aberrations. Actually, because of the effect of lens aberrations, it would be necessary to use a value of $\theta$ approximately 10 times smaller, i.e., 0.007 radians, in order to achieve $y'=1000$ Angstroms. This would reduce the current to approximately $10^{-10}$ amperes.

The foregoing paragraphs point out, in essence, that because of fundamental physical laws, when one attempts to focus a beam into a very small spot size, i.e., when one attempts to focus a beam with very high resolution, it is more effective to generate the beam from a very small source having a diameter of less than approximately 1,000 Angstroms rather than from a large source having a diameter of the order of 0.1 centimeters. Even if the physically larger ion source provides much more total ion current, the total ion current can not be effectively focused into a very small spot size on the target. A physically much smaller ion source is much more effective in focusing a large number of ions into the small spot on the target than a larger, much higher current conventional ion source. The reason for this is that the fundamental physical quantity, called brightness, is a "conserved quantity" in optical systems, because of Abbe's sine law. This means that if the initial brightness at the source is a certain value, the final brightness can never exceed that value, although it may be diminished by inefficiencies on the optical system, such as aberrations in the lens system.

Figure 3:
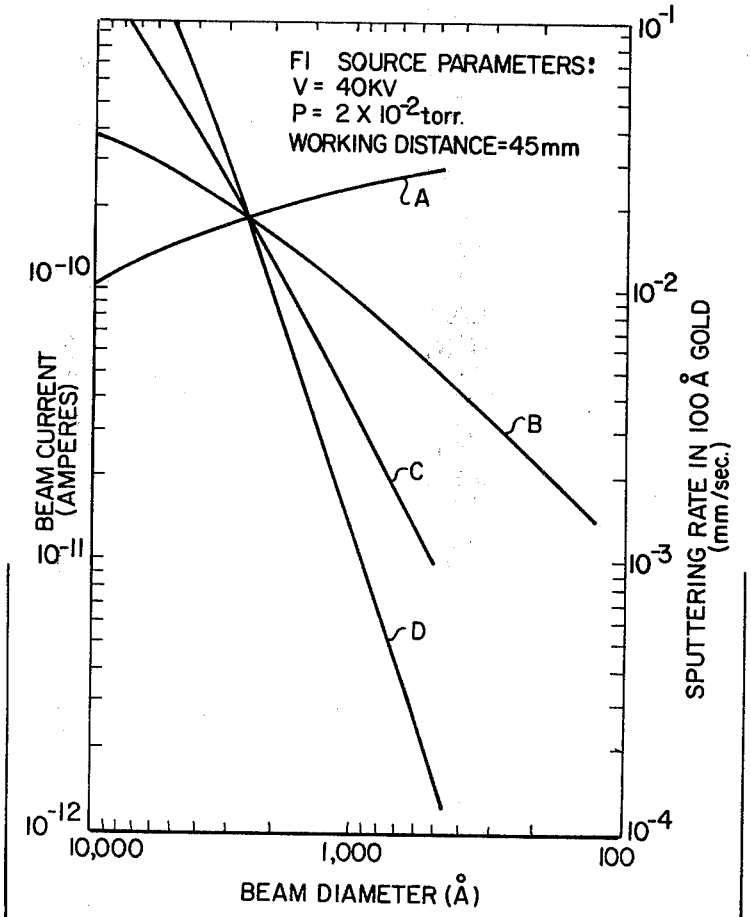
FIG. 3 is a graph showing ion beam current and relative ion beam sputtering rate through a 100 Angstrom thick gold foil as a function of ion beam diameter for a field ion gun and for a conventional duo-plasmatron ion gun with the same optical components assumed for both guns.

The field ion gun including both the field ionization source of FIG. 1 and the electrostatic optical system of FIG. 2 performs as indicated by curves A and B of the graph of FIG. 3; an emitter voltage of 40 kilovolts is applied, and argon is utilized as the gas. For the data of FIG. 3, the gas temperature is approximately 77K.°, and the emitter temperature is approximately 77K°. The gas pressure in the ionization region is approximately $2\times10^{-2}$ torr, and the working distance is 45 millimeters. Curves A and B of FIG. 3 show the argon sputtering rate through 100 Angstrom thick gold foil on the righthand vertical axis and the ionizaton current on the lefthand vertical axis. The ion beam diameter or spot size at the target is plotted along the horizontal axis. Curves C and D of FIG. 3 show the sputtering rate through 100 Angstrom thick gold foil and the ionization current for a conventional duo-plasmatron ionization source as a function of ion beam diameter. It may be seen from the curves of FIG. 3 that the ionization current for the field ionization source is substantially higher than for the conventional ionization source for beam diameters less than approximately 2,000 Angstroms.

Heretofore, ion guns have consisted of conventional (usually duo-plasmatron) ion sources coupled to various kinds of optical systems and have been used for low resolution purposes such as surface analysis and ion implantation. The usual resolution of such systems has been in the 10 to 1,000 micron range. When ion beams have been used for sputtering, or ion implantation as in the manufacture of integrated circuits and transistors, broad area beams on the order of many millimeters diameter have been employed.

This invention provides an improved field ion gun including a field ionization ion source with electrostatic optics utilized in a doublet configuration to provide significantly larger ion beam currents into 3,000 Angstrom or smaller beam spot sizes than has been provided with prior ion guns, including the field ion microprobe in the above-mentioned Levi-Setti article. No field ion gun or field ionization microprobe of the prior art has provided very cold, near-cryogenic gas temperatures and/or high gas pressures in the ionization region immediately around the emitter although field ion microscopes (which are substantially different from field ion microprobes) have provided cold gas near the emitter, this has been done to improve the resolution of the magnified image of the emitter surfaces produced by the field ion microscopes by minimizing momentum of ions transverse to the electric field which accelerates the ions to a phosphorescent screen or to a film. In contrast, the cold gas at high pressure is provided for the field ion gun of the invention in order to increase the ion beam current by increasing the supply of gas molecules available to be ionized in the high-field ionization region immediately around the emitter tip. Calculations based upon my initial experimental results show that the ion gun of this invention is capable of focusing over ten times more current into a 500 Angstrom spot than a conventional ion source.

As a result, our field ion gun, when used in conjunction with many useful processes, such as fabrication of microcircuits, may eliminate many present wet chemistry steps associated with wide area ion imlanting or wide area sputtering of the prior art. Our field ion gun may also be utilized in conjunction with controlled high resolution ion implantation of doped regions into semiconductor microcircuit wafers. Such techniques could potentially increase the density of components on present integrated circuit chips a hundred fold.

I claim:

1. A method for producing a high intensity beam of ions from a gas substantially confined within a region bounded by a conductive enclosing means having an aperture therein, said method including the steps of:

(a) heating an oriented crystalline emitter of <110> iridium within the region to cause substantial surface mobility of iridium atoms at the tip of said emitter;

(b) applying a first voltage of sufficient negative potential with respect to the enclosing means to said emitter to cause <110> build-up of the tip of said emitter;

(c) cooling said emitter to inhibit substantial surface mobility of iridium atoms at the tip of said emitter;

(d) maintaining the gas in an immediate region surrounding the tip of said emitter at a sufficiently high pressure and a sufficiently low temperature to increase the supply of low energy gas molecules available for ionization in said immediate region; and (e) applying a second voltage of sufficient negative potential with respect to the closing means to said emitter to ionize molecules of the gas in said immediate region and accelerate the resultant ions through the aperture in the enclosing means.

2. The method of claim 1 further including the step of removing contaminants from said emitter prior to applying said first voltage.

3. The method of claim 2 wherein said removing step further includes introducing oxygen into said immediate region surrounding the tip of said emitter.

4. The method of claim 1 wherein the order of steps (a) and (b) is reversed.

5. The method of claim 1 wherein a portion of the gas in the enclosing means escapes through the aperture into a vacuum chamber, the method comprising the step of maintaining the total gas pressure in the vacuum chamber at a sufficiently low pressure to avoid interference of the gas in the vacuum chamber with the high intensity beam of ions.

6. The method of claim 1 wherein the gas in said immediate region surrounding the tip of said emitter is maintained at near-cryogenic temperatures.

7. The method of claim 6 wherein said emitter, subsequent to buildup, is maintained at near-cryogenic temperatures.

8. The method of claim 5 further including the step of focusing a portion of the high intensity beam of ions in said vacuum chamber into a spot less than 3,000 Angstrom units in diameter onto a target.

9. The method of claim 8 wherein said focusing step is performed by utilizing an electrostatic lens system positioned in said vacuum chamber.

10. The method of claim 1 wherein said emitter is maintained at near-cryogenic temperatures.

11. The method of claim 1 including the step of maintaining the pressure of the gas immediately surrounding said emitter and the temperature of said emitter and said gas immediately surrounding said emitter at levels conducive to the formation of a liquid film of molecules from said gas on said emitter, thereby increasing the supply of ionizable molecules at the tip of said emitter.

12. An improved ionization source for producing a stable, reproduceable, high intensity beam of ions from gaseous molecules, said ionization source comprising in combination:

(a) an oriented crystalline emitter of <110> iridium having a longitudinally extending pointed tip;

(b) conductive means for substantially enclosing a region immediately surrounding said emitter including a limited aperture axially aligned with the longitudinally extending tip of said emitter;

(c) means for heating said emitter to a temperature sufficient to cause substantial surface mobility of the iridium atoms at the tip of said emitter;

(d) means for applying a first voltage of sufficient negative potential with respect to said conductive means to said emitter to cause <110> build-up of the tip of said emitter;

(e) means for introducing a gas into the region immediately surrounding said emitter and for maintaining said gas at a pressure sufficiently high to increase the supply of gas molecules available for ionization;

(f) means for cooling said emitter and said gas to near-cryogenic temperatures; and (g) means for applying a second voltage of sufficient negative potential with respect to said conductive means to said emitter to ionize molecules of said gas in the region immediately surrounding said emitter and accelerate the resultant ions through the aperture in said conductive means.

13. A field ion gun for producing a high intensity ion beam from gaseous molecules and for providing high resolution focusing of a portion of said in beam onto a predetermined spot, said gun comprising in combination:

(a) an oriented crystalline emitter having a longitudinally extending pointed tip;

(b) conductive means for substantially enclosing a region immediately surrounding said emitter including a limited aperture axially aligned with the longitudinally extending tip of said emitter;

(c) means for introducing gas into the region immediately surrounding said emitter;

(d) means for cooling said emitter and said gas to near-cryogenic temperatures;

(e) means for maintaining said gas in said immediate region at sufficiently high pressure to increase the supply of said molecules available for ionization;

(f) means for applying a first voltage of sufficient potential with respect to said conductive means to said emitter to ionize molecules of said gas in the region immediately surrounding said emitter and accelerate the resultant ions through the aperture in said conductive means to form the high intensity ion beam; and (g) an electrostatic lens system enclosed in a low pressure chamber for receiving the ion beam and focusing a portion of the ion beam onto a predetermined spot in response to selected control signals imposed upon said electrostatic lens system.

14. The field ion gun of claim 13 wherein the material of said oriented crystalline emitter is selected from the group consisting of <110> iridium, <100> tungsten, <111> tantalum, and <100> molybdenum.

15. The field ion gun of claim 13 wherein said cooling means includes a reservoir for containing a cold liquified gas coolant at near-cryogenic temperatures.

16. The field ion gun of claim 15 wherein said gas introducing means includes a tube coupled between a regulated high pressure source of said gas and said conductive means and wherein said tube passes through said liquified gas coolant to cool said gas.

17. The field ion gun of claim 14 wherein said conductive means is attached to and sealed with respect to said reservoir and is attached to said gas introducing means to maintain said gas at high pressure in the region immediately surrounding said emitter.

18. The field ion gun of claim 13 further including means aligned with said electrostatic lens system for supporting and positioning a target whereon said predetermined slot is located.

19. The field ion gun of claim 18 further including sensing means aligned with said target for sensing secondary electrons emitted by said target in response to the striking of said target by the focused ion beam.

20. The field ion gun of claim 19 wherein said sensing means includes a secondary electron detector.

21. The field ion gun of claim 14 further including control means for adjusting the pressure of said gas to cause a liquid film of molecules of said gas to form on said emitter, thereby increasing the availability of ionization ions at the pointed tip of said emitter because of the higher mobility of molecules in said liquid film.

22. The field ion gun of claim 19 further including display means responsive to said sensing means and to the control signal for displaying a pattern traced by the selectively deflected ion beam on the target.

* * * * *